US006126812A

United States Patent [19]

Drake et al.

[11] Patent Number: 6,126,812

[45] Date of Patent: Oct. 3, 2000

[54] GASOLINE UPGRADE WITH SPLIT FEED

[75] Inventors: Charles Alfred Drake, Nowata; An-Hsiang Wu; Scott Douglas Love, both of Bartlesville, all of Okla.

[73] Assignee: Phillips Petroleum Company, Bartlesville, Okla.

[21] Appl. No.: 09/114,992

[22] Filed: Jul. 14, 1998

[51] Int. Cl.[7] ..... C10G 35/04; C07C 15/00; C07C 2/54

[52] U.S. Cl. ..... 208/134; 585/411; 585/413; 585/418

[58] Field of Search ..... 585/411, 413, 585/418; 208/134

[56] References Cited

U.S. PATENT DOCUMENTS

| | | | |
|---|---|---|---|
| 3,753,891 | 8/1973 | Graven et al. | 208/62 |
| 3,759,821 | 9/1973 | Brennen et al. | 208/93 |
| 4,665,264 | 5/1987 | Rodewald et al. | 585/533 |
| 4,897,177 | 1/1990 | Nadler | 208/79 |
| 4,922,051 | 5/1990 | Nemet-Mavrodin et al. | 585/418 |
| 5,091,074 | 2/1992 | Maxwell et al. | 208/79 |

OTHER PUBLICATIONS

U.S. application No. 09/078,030, filed May 13, 1998.
U.S. application No. 09/114,991, filed Jul. 14, 1998.
U.S. application No. 09/035,198, filed Mar. 5, 1998.
U.S. application No. 09/057,048, filed Apr. 8, 1998.

*Primary Examiner*—Walter D. Griffin
*Assistant Examiner*—Tam M. Nguyen
*Attorney, Agent, or Firm*—Jeffrey R. Anderson

[57] ABSTRACT

A method for optimizing the yield of aromatics and light olefins in a process for the conversion of cracked gasoline to aromatics and light olefins by separating the cracked gasoline into a light fraction and a heavy fraction and contacting the light fraction with a zeolite catalyst.

10 Claims, 1 Drawing Sheet

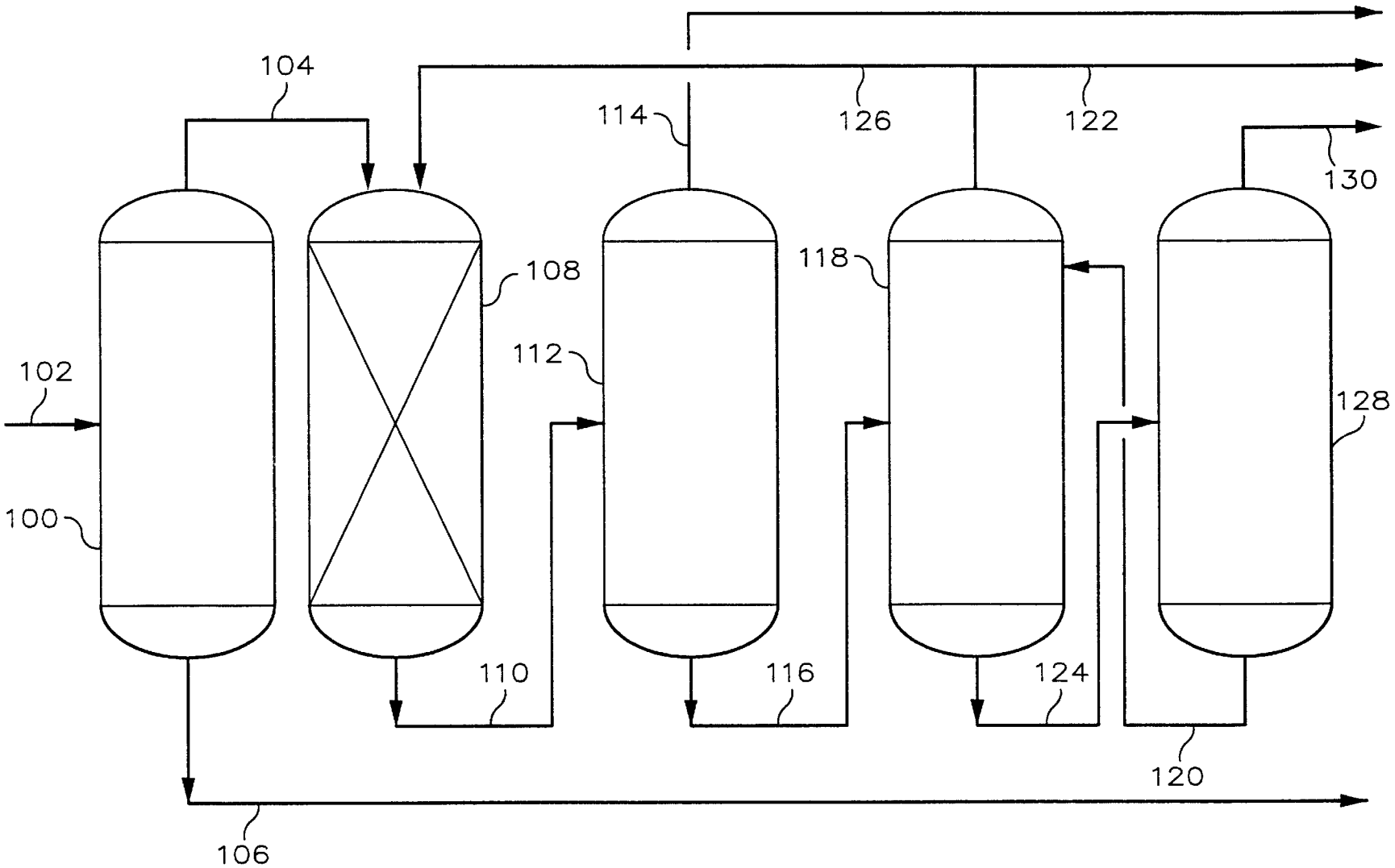
130
128
122
120
124
126
118
116
114
112
108
110
104
106
102
100

GASOLINE UPGRADE WITH SPLIT FEED

BACKGROUND OF THE INVENTION

The present invention relates to the field of hydrocarbon upgrading processes. More particularly, the invention relates to upgrading cracked gasoline to high quality gasoline and valuable petrochemicals.

It is well known to those skilled in the art that aromatics and olefins are valuable industrial chemicals which are useful in a variety of ways in the petrochemical industry. It is also well known in the art to convert hydrocarbon streams to aromatics such as benzene, toluene, and xylene (hereinafter referred to as "BTX") and light olefins such as ethylene, propylene, and butylenes (hereinafter referred to as "light olefins").

Recent efforts to convert hydrocarbons to more valuable petrochemicals have focused on converting hydrocarbons to aromatics and olefins by aromatization using zeolite containing catalysts.

The conversion of cracked gasoline to BTX and light olefins can become important if gasoline specifications require reductions in $C_5$ and heavier olefin concentrations and economics drive conversion of $C_5$–$C_7$ olefins, of relatively low value, to higher value BTX and light olefins. It is desirable to improve processes for the aromatization of $C_5$–$C_7$ olefins contained in cracked gasoline by increasing the yield of BTX and light olefins and making the processes more efficient. Therefore, a process for the conversion of cracked gasoline to BTX and light olefins which results in increased yields of BTX and light olefins from the $C_5$–$C_7$ portion of the cracked gasoline, and increased efficiency, would be a significant contribution to the art.

BRIEF SUMMARY OF THE INVENTION

It is, thus, an object of this invention to provide a process for converting a cracked gasoline to a high quality gasoline blending stock, BTX and light olefins.

A further object of this invention is to provide a more cost efficient process for converting a cracked gasoline to a high quality gasoline blending stock, BTX and light olefins.

In accordance with the present invention, a process is provided including the steps of:

- separating a cracked gasoline into a light fraction comprising at least one hydrocarbon having less than 8 carbon atoms per molecule and a heavy fraction comprising at least one hydrocarbon having more than 7 carbon atoms per molecule;
- contacting the light fraction with a catalyst composition comprising a zeolite in a reaction zone operated under reaction conditions for aromatizing hydrocarbons;
- withdrawing from the reaction zone an intermediate product stream comprising BTX and light olefins;
- separating the intermediate product stream into a raffinate stream comprising paraffins and a product stream comprising primarily BTX; and
- introducing at least a portion of the raffinate stream into the reaction zone for contact with the catalyst composition.

Other objects and advantages will become apparent from the detailed description and the appended claims.

BRIEF DESCRIPTION OF THE DRAWING

The FIGURE is a schematic flow diagram presenting an embodiment of the present invention.

DETAILED DESCRIPTION OF THE INVENTION

An important aspect of the inventive process is the use of cracked gasoline as a feedstock.

The cracked gasoline feedstock can comprise paraffins and/or olefins and/or naphthenes and/or aromatics, wherein each of these hydrocarbons preferably contains at least 5 carbon atoms per molecule.

Non-limiting examples of suitable cracked gasoline feedstocks include gasolines from catalytic oil cracking (e.g., FCC and hydrocracking) processes, pyrolysis gasolines from thermal hydrocarbon (e.g., ethane, propane and naphtha) cracking processes, coker naphtha, light coker naphtha and the like. The preferred feed for the inventive process is a gasoline boiling range feedstock suitable for use as at least a gasoline blend stock generally having a boiling range of from about 30° C. to about 210° C. The most preferred feed is a cracked gasoline necessarily containing saturates and non-saturates.

The cracked gasoline more particularly comprises BTX in the range of from about 5 weight % to about 30 weight %, more typically in the range of from about 10 weight % to about 25 weight %, and most typically from 10 weight % to 20 weight % of the cracked gasoline. The olefin concentration of the cracked gasoline is typically in the range of from about 20 weight % to about 40 weight %, more typically in the range of from about 20 weight % to about 35 weight %, and most typically from 20 weight % to 30 weight % of the cracked gasoline. The Reid vapor pressure ("RVP"; defined as the vapor pressure of a hydrocarbon at 100° F. (37.8° C.) in pounds per square inch absolute and measured using ASTM test method D-323) of the cracked gasoline is typically in the range of from about 4.0 psia to about 7.5 psia, more typically in the range of from about 4.5 psia to about 7.0 psia, and most typically from 5.0 psia to 6.5 psia.

The cracked gasoline feedstock can be separated into a light fraction comprising at least one hydrocarbon having less than 8 carbon atoms per molecule and a heavy fraction comprising at least one hydrocarbon having more than 7 carbon atoms per molecule. Preferably, the light fraction comprises hydrocarbons having from 5 to 7 carbon atoms per molecule, and even more preferably, the light fraction comprises $C_5$–$C_7$ olefins in the range of from about 40 weight % to about 60 weight % of the light fraction, and most preferably, the light fraction comprises $C_5$–$C_7$ olefins in the range of from about 45 weight % to about 55 weight % of the light fraction.

The BTX concentration of the light fraction is in the range of from about 0 weight % to about 5 weight %, preferably in the range of from about 1 weight % to about 4 weight %, and most preferably from 2 weight % to 3 weight % of said light fraction.

The final boiling point of the light fraction as determined using ASTM test method D-3710, at atmospheric pressure, is in the range of from about 80° C. to about 100° C., preferably in the range of from about 85° C. to about 95° C., and most preferably in the range of from 88° C. to 92° C.

The light fraction comprises at least about 50% by weight of the olefins of the cracked gasoline, preferably, at least about 80%, and most preferably at least 90%.

Separation of the cracked gasoline feedstock into the light fraction and the heavy fraction results in the concentration of the most reactive hydrocarbons, in an aromatization reaction, in the light fraction. The $C_5$–$C_7$ olefins contained within the light fraction are believed to be the most reactive in an aromatization reaction as described herein. As a result, the process can be operated in a more efficient manner by utilizing a smaller reactor vessel and less zeolite catalyst to effect the conversion of the light fraction to BTX and light olefins as compared to the size of the reactor vessel and amount of catalyst necessary for converting the full cracked gasoline stream.

Furthermore, the relatively low concentration of BTX in the light fraction will shift the equilibrium, for the conversion of olefins to BTX, toward more BTX as compared with the case where the entire cracked gasoline feedstock (having a higher BTX concentration) is aromatized.

The heavy fraction produced by the separation is a high quality gasoline having a reduced RVP as compared to the RVP of the cracked gasoline.

More particularly, the RVP of the heavy fraction will be in the range of from about 0.5 psia to about 3.5 psia, preferably in the range of from about 1.0 psia to about 3.0 psia, and most preferably from 1.5 psia to 2.5 psia.

The separation of the cracked gasoline produces a heavy fraction having a low concentration of olefins. The olefin concentration of the heavy fraction is low as compared to the olefin concentration of the cracked gasoline feedstock. More particularly, the olefin concentration of the heavy fraction will be in the range of from about 5 weight % to about 18 weight %, preferably in the range of from about 5 weight % to about 15 weight %, and most preferably from 10 weight % to 15 weight % of the heavy fraction.

The low RVP and low olefin concentration of the heavy fraction make it a very high quality gasoline blending stock.

The light fraction can then be aromatized by contacting the light fraction, by any suitable manner, with the catalyst composition, as described herein, contained within a reaction zone to produce an intermediate product stream.

The aromatization step is preferably carried out under sufficient reaction conditions to effect the conversion of the light fraction to BTX and light olefins.

The aromatization step can be operated as a batch process step or, preferably, as a continuous process step. In the latter operation, a solid catalyst bed or a moving catalyst bed or a fluidized catalyst bed can be employed. Any of these operational modes have advantages and disadvantages, and those skilled in the art can select the one most suitable for a particular feed and catalyst.

The reaction temperature is more particularly in the range of from about 400° C. to about 800° C., preferably from about 450° C. to about 750° C., and most preferably from 500° C. to 700° C. The contacting pressure can range from about 15 psia to about 500 psia, preferably from about 25 psia to about 450 psia, and most preferably from 50 psia to 400 psia.

The flow rate at which the light fraction is charged to the aromatization reaction zone is such as to provide a weight hourly space velocity ("WHSV", defined as the pounds/hour of feed to the reaction zone divided by the total pounds of catalyst contained within the reaction zone) in the range of from about 0.01 $hr.^{-1}$ to about 1000 $hr.^{-1}$, preferably from about 0.25 $hr.^{-1}$ to about 250 $hr.^{-1}$ and most preferably from 0.5 $hr^{-1}$ to 100 $hr.^{-1}$.

The catalyst composition useful in the present invention can comprise, consist essentially of, or consist of a zeolite and, optionally, an activity promoter. The zeolite can be acid-leached. The promoter is preferably impregnated or coated on the zeolite.

The weight of the promoter in the catalyst composition can be in the range of from about 0.01 to about 10, preferably about 0.05 to about 8, and most preferably 0.1 to 5 grams per 100 grams of the composition.

The catalyst composition can also comprise a binder. The weight of the binder generally can be in the range of from about 1 to about 50, preferably about 5 to about 40, and most preferably 5 to 35 grams per 100 grams of the catalyst composition. The zeolite generally makes up the rest of the catalyst composition.

Any commercially available zeolite which can catalyze the conversion of a hydrocarbon to an aromatic compound and an olefin can be employed. Examples of suitable zeolites include, but are not limited to, those disclosed in Kirk-Othmer Encyclopedia of Chemical Technology, third edition, volume 15 (John Wiley & Sons, New York, 1991) and in W. M. Meier and D. H. Olson, "Atlas of Zeolite Structure Types," pages 138–139 (Butterworth-Heineman, Boston, Mass., 3rd ed. 1992). The presently preferred zeolites are those having medium pore sizes. ZSM-5 and similar zeolites that have been identified as having a framework topology identified as MFI are particularly preferred because of their shape selectivity.

Any promoter that can enhance the production of aromatics in an aromatization process which converts a hydrocarbon or a mixture of hydrocarbons into light olefins and aromatic hydrocarbons can be used. The term "promoter" generally refers to either metal or a metal oxide selected from Groups IA, IIA, IIIA, IVA, VA, VIA, IIB, IIIB, IVB, VB, VIB, and VIII of the CAS version of the Periodic Table of Elements, CRC Handbook of Chemistry and Physics, Boca Raton, Fla. (74th edition; 1993–1994). The term "metal" used herein refers to both "metal" and "elements" of the Periodic Table because some elements may not be considered as metals by those skilled in the art. The term "metal" also includes metal oxide. Examples of such promoters include, but are not limited to, sulfur, phosphorus, silicon, boron, tin, magnesium, germanium, zinc, titanium, zirconium, molybdenum, lanthanum, cesium, iron, cobalt, nickel, and combinations of two or More thereof. The preferred promoter comprises zinc and boron.

Any binders known to one skilled in the art for use with a zeolite are suitable for use herein. Examples of suitable binders include, but are not limited to, clays such as for example, kaolinite, halloysite, vermiculite, chlorite, attapulgite, smectite, montmorillonite, illite, saconite, sepiolite, palygorskite, diatomaceous earth, and combinations of any two or More thereof; aluminas such as for example α-alumina and γ-alumina; silicas; alumina-silica; aluminum phosphate; aluminum chlorohydrate; and combinations of two or More thereof. Because these binders are well known to one skilled in the art, description of which is omitted herein. The presently preferred binders are alumina and silica because they are readily available.

The intermediate product stream comprises BTX in the range of from about 20 weight % to about 50 weight %, preferably in the range of from about 20 weight % to about 40 weight %, and most preferably from 25 weight % to 35 weight % of the intermediate product stream. The concentration of light olefins in the intermediate product stream is in the range of from about 10 weight % to about 40 weight %, preferably in the range of from about 15 weight % to about 35 weight %, and most preferably from 20 weight % to 30 weight % of the intermediate product stream.

The intermediate product stream can be separated into a raffinate stream comprising paraffins or light olefins, or both, and a product stream comprising BTX.

The rafffinate stream comprises paraffins in the range of from about 30 weight % to about 60 weight %, preferably in the range of from about 35 weight % to about 55 weight %, and most preferably in the range of from 40 weight % to 50 weight %. The raffinate stream can further comprise light olefins in the range of from about 35 weight % to about 65 weight %, preferably in the range of from about 40 weight % to about 60 weight %, and most preferably in the range of from 45 weight % to 55 weight %.

The product stream comprises BTX in the range of from about 70 weight % to about 100 weight %, preferably in the range of from about 80 weight % to about 99.5 weight %, and most preferably in the range of from 85 weight % to 99 weight % of the product stream.

At least a portion of the raffinate stream can be introduced to the reaction zone described above for contact with the catalyst composition described above.

The separation of the intermediate product stream into the raffinate stream and the product stream produces a yield of BTX product. The BTX yield is further increased by recycling at least a portion of the highly paraffinic raffinate stream to the reaction zone for at least partial conversion to BTX and light olefins.

In another embodiment, at least a portion of the hydrocarbons having less than 5 carbon atoms per molecule, including light olefins, can be removed from the intermediate product stream prior to separating the intermediate product stream into the raffinate stream and the product stream. These removed hydrocarbons can be further processed downstream to produce valuable ethylene, propylene and butylene products.

In another embodiment, the separation of the intermediate product stream can be accomplished by contacting the intermediate product stream with a suitable solvent stream capable of removing BTX from the intermediate product stream. The preferred solvent is sulfolane. The solvent stream, hereinafter referred to as "lean solvent stream", extracts BTX from the intermediate product stream producing a BTX rich solvent stream comprising BTX and a raffinate stream primarily comprising paraffins. The BTX rich solvent stream can be separated to form a product stream comprising BTX and the lean solvent stream.

Referring now to the FIGURE, a cracked gasoline feedstock enters a first separator vessel 100, which defines a first separation zone, via conduit 102, and is separated into a light fraction and a heavy fraction. The light fraction and the heavy fraction are removed from first separator vessel 100 via conduits 104 and 106, respectively. The light fraction is then charged to a reactor 108, which defines an aromatization reaction zone, and contacts a catalyst composition comprising zeolite contained within the aromatization reaction zone. The light fraction is converted to an intermediate product stream which is removed from reactor 108 via conduit 110. The intermediate product stream is then charged to a second separator vessel 112 wherein hydrocarbons having less than 5 carbon atoms per molecule are removed from the intermediate product stream and exit the second separator vessel 112 via conduit 114. The remaining portion of the intermediate product stream is removed from the second separator vessel 112 via conduit 116. The remaining portion of the intermediate product stream is then charged to a contactor vessel 118, which defines a contacting zone, and is contacted by a lean solvent stream, charged to the contactor vessel 118 via conduit 120, forming a raffinate stream and a BTX rich solvent stream. The raffinate stream is removed from contactor vessel 118 via conduit 122 for further downstream processing and the BTX rich solvent stream is removed from the contactor vessel 118 via conduit 124. At least a portion of the raffinate stream is charged to the reactor 108, via conduit 126, for contact with the catalyst composition contained within the reaction zone. The BTX rich solvent stream is charged to a third separator vessel 128 and is separated into a product stream and the lean solvent stream. The lean solvent stream exits third separator vessel 128 via conduit 120 and the product stream is removed from the third separator vessel 128 via conduit 130.

The following examples are provided to further illustrate this invention and are not to be considered as unduly limiting the scope of this invention.

EXAMPLE I

This example illustrates the preparation of a catalyst which was subsequently used as a catalyst in a test run of the inventive process for the conversion of gasoline boiling range hydrocarbons to BTX and light olefins.

The catalyst was prepared by physically mixing a 14 gram sample of a commercially available ZSM-5 catalyst provided by Chemie Uetikon under product designation "PZ2/50H" (Zeocat) with 15 grams of a colloidal silica binder solution manufactured by Dupont under product designation Ludox® AS-40 and 0.7 gram of zinc hexaborate. The formed mixture was then extruded and dried at room temperature followed by steaming at 650° C. for 4 hours.

EXAMPLE II

This example illustrates the conversion of the lower value $C_5$–$C_7$ olefins in cracked gasoline to BTX and light olefins and the production of low RVP and low olefin gasoline blend stock that results from separating a cracked gasoline into a light fraction and a heavy fraction and then contacting the light fraction with the catalyst of Example I.

A 5 gram sample of the catalyst of Example I was placed into a stainless steel tube reactor with a length of about 20 inches and an inside diameter of about 0.5 inch. Cracked gasoline from a catalytic cracking unit of a refinery was separated into a light fraction and a heavy fraction which were analyzed by means of a gas chromatograph. Results of the analyses are summarized in the Table. The light fraction was passed through the reactor at a flow rate of about 15 mL/hour, at a temperature of about 550° C. and a pressure of about 40 psia for aromatization. The formed product stream exited the reactor tube and passed through several ice-cooled traps. Liquid and gaseous product samples were analyzed by means of a gas chromatograph. Results of the analyses of the product stream after 6 hours on stream are summarized in the Table.

TABLE

| Component | Cracked Gasoline | Light Fraction | Heavy Fraction | Product |
|---|---|---|---|---|
| $C_4$-Paraffins & $H_2$ (wt. %) | — | — | — | 17.4 |
| Ethylene (wt. %) | — | — | — | 6.9 |
| Propylene (wt. %) | — | — | — | 12.6 |
| Butylenes (wt. %) | 0.2 | 0.6 | — | 7.5 |
| $C_5$ paraffins (wt. %) | 6.2 | 18.1 | 0.3 | 8.7 |
| $C_5$ olefins & naphthenes (wt. %) | 9.4 | 25.5 | 1.3 | 5.4 |
| $C_6$ paraffins (wt. %) | 6.9 | 16.8 | 1.9 | 2.7 |
| $C_6$ olefins & naphthenes (wt. %) | 9.4 | 21.3 | 3.5 | 0.6 |
| Benzene (wt. %) | 1.2 | 2.7 | 0.4 | 8.7 |
| $C_7$ paraffins (wt. %) | 5.5 | 6.9 | 4.8 | 1.2 |
| $C_7$ olefins & naphthenes (wt. %) | 10.0 | 8.1 | 10.9 | 0.6 |
| Toluene (wt. %) | 5.0 | — | 7.5 | 14.7 |
| $C_8$ paraffins (wt. %) | 4.6 | — | 6.9 | — |
| $C_8$ olefins & naphthenes (wt. %) | 4.2 | — | 6.3 | — |

TABLE-continued

| Component | Cracked Gasoline | Light Fraction | Heavy Fraction | Product |
|---|---|---|---|---|
| Ethyl Benzene (wt. %) | — | — | — | 0.3 |
| Xylene (wt. %) | 8.2 | — | 12.3 | 9.3 |
| $C_9$+ paraffins (wt. %) | 6.4 | — | 9.6 | 0.4 |
| $C_9$+ olefins & naphthenes (wt. %) | 1.7 | — | 2.6 | — |
| $C_9$+ aromatics (wt. %) | 18.3 | — | 27.5 | 3.0 |
| Unknowns (wt. %) | 2.8 | — | 4.2 | — |
| Total | 100 | 100 | 100 | 100 |
| Petrochemicals (wt. %) | | | | |
| (BTX, $C_2$=, $C_3$= & $C_4$=) | 14.6 | 3.3 | 20.2 | 59.7 |
| $C_5$–$C_7$ olefins (wt. %) | 23.6 | 48.0 | 11.4 | 5.1 |
| RVP (psia), Calculated | 5.7 | — | 1.8 | — |

As presented in the Table, the heavy fraction (high quality gasoline blend stock) produced by the inventive process has a significantly decreased concentration of $C_5$–$C_7$ olefins and a significantly lowered RVP as compared to the cracked gasoline. In addition, the concentration of $C_5$–$C_7$ olefins in the product stream was significantly decreased with a significant increase in petrochemicals concentration as compared to the concentrations of $C_5$–$C_7$ olefins and petrochemicals in the light fraction.

Reasonable variations, modifications, and adaptations can be made within the scope of the disclosure and the appended claims without departing from the scope of this invention.

That which is claimed is:

1. A process for converting a cracked gasoline comprising at least one olefin to valuable petrochemicals and high quality gasoline, said process comprising:

separating said cracked gasoline into a light fraction comprising at least one hydrocarbon having less than 8 carbon atoms per molecule and a heavy fraction comprising at least one hydrocarbon having more than 7 carbon atoms per molecule;

contacting said light fraction with a catalyst composition comprising a zeolite in a reaction zone operated under reaction conditions for aromatizing hydrocarbons;

withdrawing from said reaction zone an intermediate product stream comprising BTX and light olefins;

separating said intermediate product stream into a raffinate stream comprising paraffins and light olefins and a product stream comprising primarily BTX; and introducing at least a portion of said raffinate stream into said reaction zone for contact with said catalyst composition.

2. A process as recited in claim 1 wherein said light fraction comprises $C_5$–$C_7$ olefins in the range of from about 40 weight % to about 60 weight % of said light fraction.

3. A process as recited in claim 2 further comprising the step of:

removing at least a portion of the hydrocarbons having less than 5 carbon atoms per molecule from said intermediate product stream prior to separating said intermediate product stream.

4. A process as recited in claim 3 wherein the separation of said intermediate product stream comprises the steps of:

contacting said intermediate product stream with a lean solvent comprising sulfolane to extract BTX from said intermediate product stream to form a BTX rich solvent stream and said raffinate stream; and separating said BTX rich solvent stream to form said product stream and said lean solvent.

5. A process as recited in claim 4 wherein said reaction zone is operated at a temperature in the range of from about 400° C. to about 800° C., a pressure in the range of from about 0 psia to about 500 psia, and a weight hourly space velocity in the range of from about 0.01 $hr.^{-1}$ to about 1000 $hr.^{-1}$.

6. A process as recited in claim 5 wherein said zeolite is ZSM-5.

7. A process as recited in claim 6 wherein said catalyst composition further comprises a promoter selected from the group consisting of zinc, boron and mixtures thereof.

8. A process as recited in claim 7 wherein said light fraction has a final boiling point as determined using ASTM test method D-3710 in the range of from about 80° C. to about 100° C.

9. A process as recited in claim 7 wherein at least about 50% by weight of the olefins of said cracked gasoline are included in said light fraction after separating said cracked gasoline.

10. A process as recited in claim 7 wherein at least about 80% by weight of the olefins of said cracked gasoline are included in said light fraction after separating said cracked gasoline.

* * * * *